US006075197A

United States Patent [19]

Chan

[11] Patent Number: 6,075,197

[45] Date of Patent: Jun. 13, 2000

[54] APPARATUS AND METHOD FOR PROVIDING INTERACTIVE DRUM LESSONS

[76] Inventor: Ying Kit Chan, 20 Lee Chung Street, 13th Floor, Chai Wan, The Hong Kong Special Administrative Region of the People's Republic of China

[21] Appl. No.: 09/178,966

[22] Filed: Oct. 26, 1998

[51] Int. Cl.[7] ..... G10H 3/12

[52] U.S. Cl. ..... 84/730; 84/738; 84/746; 84/DIG. 12; 84/DIG. 24

[58] Field of Search ..... 84/470 R, 477 R, 84/478, 738, 743–746, DIG. 12, 730–732, DIG. 24

[56] References Cited

U.S. PATENT DOCUMENTS

| | | | |
|---|---|---|---|
| 4,479,412 | 10/1984 | Klynas | 84/1.04 |
| 5,140,889 | 8/1992 | Segan et al. | 84/723 |
| 5,266,735 | 11/1993 | Shaffer et al. | 84/609 |
| 5,270,475 | 12/1993 | Weiss et al. | 84/603 |
| 5,739,457 | 4/1998 | Devecka | 84/743 |

*Primary Examiner*—Stanley J. Witkowski

*Attorney, Agent, or Firm*—Cohen, Pontani, Lieberman & Pavane

[57] ABSTRACT

An interactive drum set includes a storage device for storing data representing sounds of a plurality of background music styles, sounds of a plurality of drum beat sequences, and sounds of a plurality of percussion instruments. The drum set also includes a plurality of drum plates for receiving user-directed forces, each of the plurality of drum plates being associated with the data representing sounds of one of the plurality of percussion instruments. A sensor disposed at each of the plurality of drum plates detects the user-directed forces and generates a signal indicative of the user-directed forces. A triggering device operatively connected to each sensor outputs a trigger signal when the signal of the sensor exceeds a threshold value. A user-interface device responsive to user commands supplies signals indicative of a user's selection of at least one background music style and/or at least one drum beat sequence. A controller, responsive to the trigger signal of the triggering device and the signal from the user-interface device, retrieves and outputs data from the storage device representing sounds of at least one background music style, at least one drum beat sequence, and/or one of the plurality of percussion instruments.

14 Claims, 7 Drawing Sheets

FIG. 6A

| Location | Description | Specification | Qty. |
|---|---|---|---|
| PCB1 | 8741-11 PCB | | 1 |
| COB1 | 8741-22 COB for U1 | | 1 |
| COB2 | 8741-33 COB for U2 | | 1 |
| COB3 | 8741-41 COB for U3 | | 1 |
| U1 | W56120 DICE FORM | | 1 |
| U2 | W56106 DICE FORM | | 1 |
| U3 | W5281 DICE FORM | | 1 |
| U4 | KA2209 PACKAGE | TDA2822M/KA2209B | 1 |
| R1,R2,R4,R8 | 510 Ω FIX RESISTOR | 1/4W ± 5% | 4 |
| 43,46 | 1.2M FIX RESISTOR | 1/4W ± 5% | 2 |
| R5 | 390 Ω FIX RESISTOR | 1/4W ± 5% | 1 |
| R7 | 750K FIX RESISTOR | 1/4W ± 5% | 1 |
| R9-R13,R23, R26,R29,R32 | 18K FIX RESISTOR | 1/4W ± 5% | 9 |
| R14 | 1.5M FIX RESISTOR | 1/4W ± 5% | 1 |
| R15 | 5.6K FIX RESISTOR | 1/4W ± 5% | 1 |
| R16 | 1K FIX RESISTOR | 1/4W ± 5% | 1 |
| R17 | 10KD VOLUMN | 1/4W ± 10% W/O LOCK 16mm | 1 |
| R18 | 1.8K FIX RESISTOR | 1/4W ± 5% | 1 |
| R19,R20 | 10 Ω FIX RESISTOR | 1/4W ± 5% | 2 |
| R21 | 100 Ω FIX RESISTOR | 1/4W ± 5% | 1 |
| R22,R25,R28, R31 | 100K FIX RESISTOR | 1/4W ± 5% | 4 |
| R24,R27,R30, R33 | 22K FIX RESISTOR | 1/4W ± 5% | 4 |
| R34 | 820 Ω FIX RESISTOR | 1/4W ± 5% | 1 |
| C1-C6, C11,C12 | 104 CERAMIC CAP. | +80%-20% 12V | 8 |
| C7 | 2.2uF ELECT-CAP. | ± 20% 12V | 1 |
| C8,C15,C17, C19,C21 | 502 CERAMIC CAP. | +80%-20% 12V | 1 |
| C9 | 10uF ELECT-CAP. | ± 20% 12V | 1 |
| C10 | 103 CERAMIC CAP. | +80%-20% 12V | 1 |
| C13 | 220 uF ELECT-CAP. | ± 20% 12V | 1 |

FIG. 6B

| Location | Description | Specification | Qty. |
|---|---|---|---|
| C14 | 470 uF ELECT-CAP. | 1/4W ± 5% | 1 |
| C16,C18,C20, C22 | 403 CERAMIC CAP. | +80%-20% 12V | 4 |
| Q1-Q5 | 9014C TRANSISTOR | NPN CENTER B | 5 |
| D1,D4-D9 | IN4148 DIODE | 0.25W | 7 |
| BZ1-BZ4 | PIEZO FILM | 27mm | 4 |
| PCB2 | 8741-51 PCB | FOR CENTRAL KEYBOARD | 1 |
| PCB3 | 8741-61 PCB | FOR JACK SOCKETS | 1 |
| PCB4 | 8741-71 PCB | FOR VOL & LED | 1 |
| PCB5 | 8741-91 PCB | FOR PADDLE | 1 |
| SW1,SW9, SW11-15, SW16-24 | BE301377 | RUBBER KEYPAD | 24 |
| SW29 | POWER ON/OFF SWITCH | 1P2T PRESS SWITCH WITH LOCK | 1 |
| D10 | LED | SUPER BRIGHT | 1 |
| SPK1 | 4 Ω SPEAKER | ø 3" 2W | 1 |
| SOCKETS | EJ-3503 | Sockets on 8741-61 | 5 |
| JACK1 | 3.5mm JACK | with 28" TWIN WIRE | 4 |
| JACK2 | 3.5mm.JACK | with 53" TWIN WIRE | 1 |

APPARATUS AND METHOD FOR PROVIDING INTERACTIVE DRUM LESSONS

BACKGROUND OF THE INVENTION

1. Field of the Invention

The present invention relates to electronic percussion instruments and, more particularly, an electronic interactive drum set and a method for teaching youngsters the basic rhythms and beats of percussion instruments for different musical styles.

2. Description of the Related Art

Many prior art electronic music systems for educational applications rely on elaborate computer hardware and software such as, for example, the Musical Instrument Digital Interface (MIDI) to provide instructive aids to a user. Such systems are expensive to acquire as well as too complex to be used by most children. Oftentimes, the user must invest a significant amount of time and effort to learn about the system itself. These and other factors generally discourage widespread usage of these systems, even though these systems have a wide range of capabilities.

U.S. Pat. No. 5,739,457 to Devecka discloses an interactive electronic drum system for use in a coin-operated environment. The system includes electronic drum pads for a snare, a hi-hat cymbal, a crash cymbal, a ride cymbal, four toms; a bass drum foot activator or pedal; a foot pedal or activator for controlling the opening and closing of the hi-hat; and an additional foot pedal or activator which may be included to add a variety of additional sound effects, such as "wa-wa" or the like. Each of the drum pads or pedals has one or more associated LEDs to guide a user by visually cuing the user to strike the appropriate pads or pedals. The drum system further includes a personal computer, a display screen, a CD ROM drive and a set of speakers. The system has a jam lesson mode in which the user may select a style of music such as, for example, Rock, Dance/Rap, Country, Heavy Metal, and Jazz. The system then verbally explains how to play the selected music style and encourages the user to try a "simple example." Next, the system lights up the LEDs in sequence to cue the proper activation of hi-hat, snare and bass drum etc. Then, the system demonstrates a suitable beat by playing the cymbals, snare drum and bass drum etc. Afterward, the system plays a background musical piece of the selected music style so as to show the user how the beat keeps up with the music. The user then practices for a period of time. Feedback is provided at the end of the lesson. The system also has a "jam alone" mode, in which the user can play the drums with no instruction or cuing so that the user can test his ability to play what he has already learned in previous lessons. Devecka's system is, however, complex and costly to manufacture as it requires a myriad of computer components.

U.S. Pat. No. 5,140,889 to Segan et al. discloses an electronic percussion synthesizer assembly having a spider-like drumhead support structure which minimizes the damping effect on the drum surface. The spider-like structure has legs configured to serve as shock absorbers for attenuating vibrations from the drumhead. The assembly also includes an electronic control unit, responsive to user commands, for controlling different drum sounds to be generated as the drum pads are struck and for enabling different background rhythms to be played as a user plays along on the drum pads.

U.S. Pat. No. 5,266,735 to Shaffer et al. discloses a music training system for assisting a person to play a stringed musical instrument by visually cuing the sequence of notes on the musical instrument. The system includes a controller having an input for receiving musical data and a plurality of LEDs mounted on the musical instrument.

SUMMARY OF THE INVENTION

Accordingly, an object of the present invention is to provide a simple, low-cost method for providing interactive drum lessons and an interactive drum set which avoid the disadvantages of the prior art and which can be readily operated by children.

Another object of the present invention is to provide an electronic drum set having a plurality of drum pads or plates and which plays digitally recorded drum sounds of various percussion instruments in response to forces imparted to the drum pads.

Still another object of the present invention is to provide an electronic drum set which is capable of playing a plurality of background music styles and at least two different drum beat sequences predeterminedly associated with each of the background music styles.

In one embodiment of the present invention, the interactive drum set includes a storage device for storing data representing sounds of at least one background music style, sounds of at least one drum beat sequence, and sounds of a plurality of percussion instruments. The drum set also includes a plurality of drum plates for receiving user-directed forces, each of the plurality of drum plates being associated with the data representing sounds of one of the plurality of percussion instruments. A sensor disposed at each of the plurality of drum plates detects the user-directed forces and generates a signal indicative thereof. A triggering device operatively connected to each of the sensors outputs a trigger signal when the sensor signal exceeds a threshold value. A user-interface device responsive to user commands supplies signals indicative of a user's selection of a background music style and/or a drum beat sequence. A controller, responsive to the trigger signal of the triggering device and the user-command signal from the user-interface device, retrieves and outputs data from the storage device representing sounds of at least one background music style, at least one drum beat sequence, and/or one of the plurality of percussion instruments.

Accordingly, the drum set has four operating modes in which it plays: (1) a selected background music style and a selected drum beat sequence; (2) a selected background music style without any drum beat sequence; (3) a selected drum beat sequence without any background music; and (4) none of the background music styles or drum beat sequences. Each of these modes provides a different level of challenge to the user so as to progressively guide user to learn a selected drum beat sequence for a background music style.

In accordance with another embodiment of the present invention, a method of providing interactive drum lessons to a user includes the steps of:

(a) associating each of a plurality of drum plates with sounds of one of a plurality of percussion instruments such that when one of the plurality of drum plates is struck by the user, sounds of one of the plurality of percussion instruments associated with one of the struck drum plates is outputted;

(b) associating sounds of a background music style with a drum beat sequence;

(c) outputting sounds of said background music style and said drum beat sequence when indicated by the user so that the user can become familiarized with said drum beat sequence by listening to the sounds of both said background music style and said drum beat sequence and by striking the plurality of drum plates in a sequence similar to said drum beat sequence;

(d) outputting sounds of only said drum beat sequence when indicated by the user so that the user may learn said drum beat sequence by listening only to the sounds of said drum beat sequence and by striking the plurality of drum plates in a sequence substantially the same as said drum beat sequence;

(e) outputting sounds of only the background music style when indicated by the user so that the user may perform the drum beat sequence while the sounds of said background music style are being outputted; and (f) outputting none of the sounds of said background music style and said drum beat sequence when indicated by the user so that the user may engage in free play of the drum plates.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference numerals denote similar or corresponding elements throughout the several views:

FIGS. 6A and 6B are a parts list for the circuit diagram of FIGS. 5A and 5B.

DETAILED DESCRIPTION OF THE CURRENTLY PREFERRED EMBODIMENTS

Figure 1:
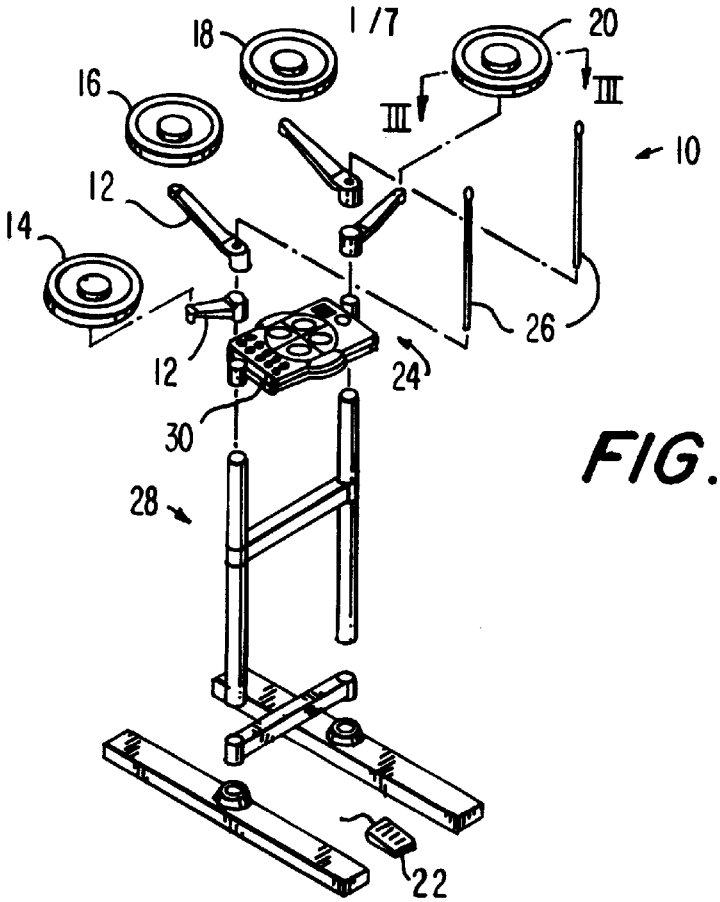
FIG. 1 is an exploded view of the interactive drum set constructed in accordance with the present invention.

Referring now to the drawings, FIG. 1 illustrates a presently preferred embodiment of the interactive drum set 10 of the present invention. The interactive drum set 10 includes a plurality of support arms 12, a plurality of drum plates 14, 16, 18, 20 mounted on the support arms 12, a foot pedal 22 (for activating, for example, a bass drum), a user-interface device 24, drum sticks 26, and a frame 28 for mounting the aforementioned components. Although only four drum plates and one foot pedal are shown, it is contemplated that any number of drum plates and foot pedals may be provided as a matter of design choice.

Figure 2:
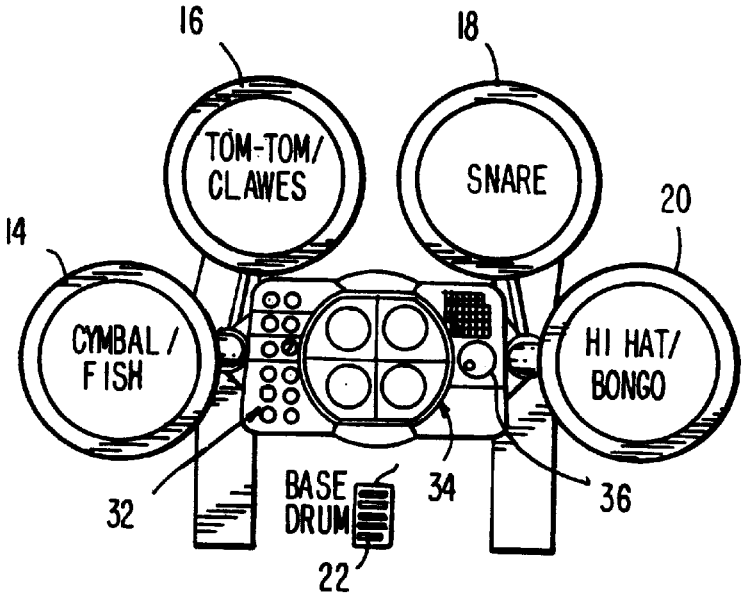
FIG. 2 is a top view of the interactive drum set of FIG. 1.

As best seen in FIG. 2, the user-interface device 24 has a control panel 30 with a first key pad arrangement 32 for facilitating user selection of a variety of background music styles (e.g., Latin, Rock, Blues, Dance, Funk, and Heavy Metal), a second key pad arrangement 34 for selecting and deselecting a particular drum beat sequence (e.g., "Drum beat A" or "Drum beat B") predeterminedly associated with a chosen background music style, and a tempo control switch 36 (e.g., a rotary knob) for varying the tempo of the playback of the background music and drum beat sequences. A drum beat sequence may consist of a sequence of polyphonic sounds of various percussion instruments such as, for example, cymbals, bass drums, snare drums, hi-hats etc. The key pad arrangements 32, 34 include, for example, a plurality of manual ON/OFF switches activatable by a user.

As will be described below and as indicated in FIG. 2, each of the drum plates 14, 20 16, 18, 20 is electronically associated with sounds of one or more percussion instruments. The particular association of instrument sounds with each drum plate depends on the background music style selected by the user. Thus, drum plate 14 may, for example, correspond to cymbals (when the selected background music style is Rock, Heavy Metal, Dance, Blues or Funk) or Fish (when the selected background music style is Latin); drum plate 16, tom-toms (when the selected background music style is Rock, Heavy Metal, Dance, Blues or Funk) or Clawes (when the selected background music style is Latin); drum plate 18, snare drum (for all background music styles); and drum plate 20, hi-hat (when the selected background music style is Rock, Heavy Metal, Dance, Blues or Funk) or bongo drums (when the selected background music style is Latin).

Figure 3:
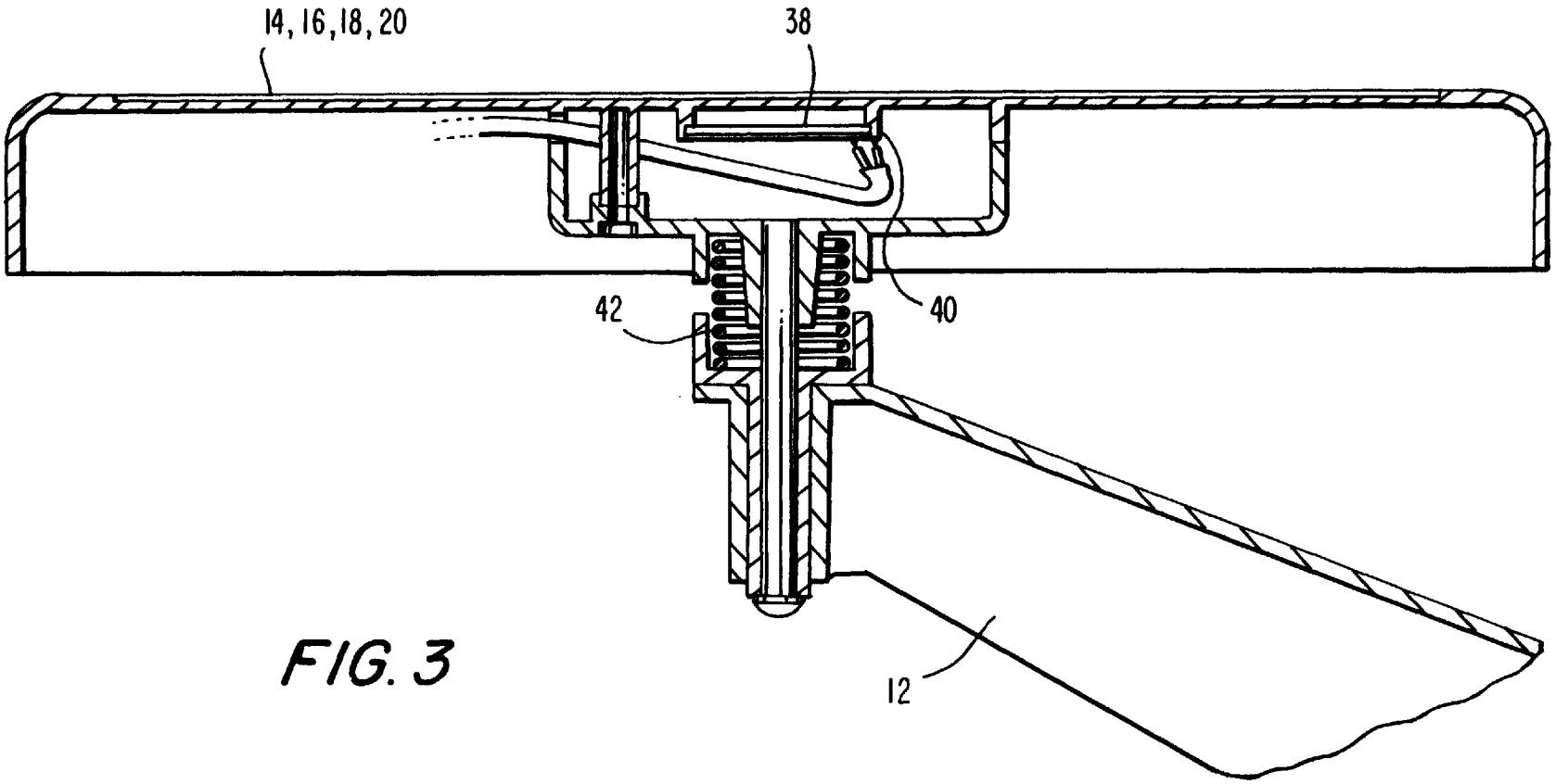
FIG. 3 is a sectional view of the drum plate along line III—III in FIG. 1.

Preferably, as shown in FIG. 3, the interactive drum set 10 includes a sensor 38 (e.g., a force/strain sensor or a piezoelectric transducer) for detecting a user-directed force imparted to a strike region of each of the drum plates 14, 16, 18, 20 such as, for example, the central area of the drum plate and for generating a signal indicative or representative of the applied force. It is within the contemplation of the present invention that other types of sensors such as, for example, ON/OFF switches may be optionally employed. The particular arrangement of these sensors will be apparent to an ordinary artisan from the disclosure described herein. In any event, the sensor 38 may, for example, be attached to the underside or the bottom surface proximate the central region of each drum plate and so mounted as to detect any deflection or movement resulting from a force imparted to the drum plate. Preferably, the sensor 38 is hard mounted to the drum plate, i.e., with no resilient material interposed between the sensor 38 and the drum plate so that user-imparted forces can be transmitted to the sensor 38 without significant attenuation. As shown in FIG. 3, in a preferred configuration, the bottom surface of the drum plate has an annular boss or an annular wall 40 depending therefrom in which the sensor 38 is disposed.

Still referring to FIG. 3, each drum plate is resiliently mounted to the cantilevered end of its respective support arm 12 by, for example, a helical spring 42 such that the drum plates 14, 16, 18, 20 are mechanically isolated from each other. In other words, forces imparted to one drum plate will not be communicated to another drum plate thereby avoiding unintended activation of sensors mounted on the other drum plates to thereby prevent the generation of unwanted sounds.

Figure 4:
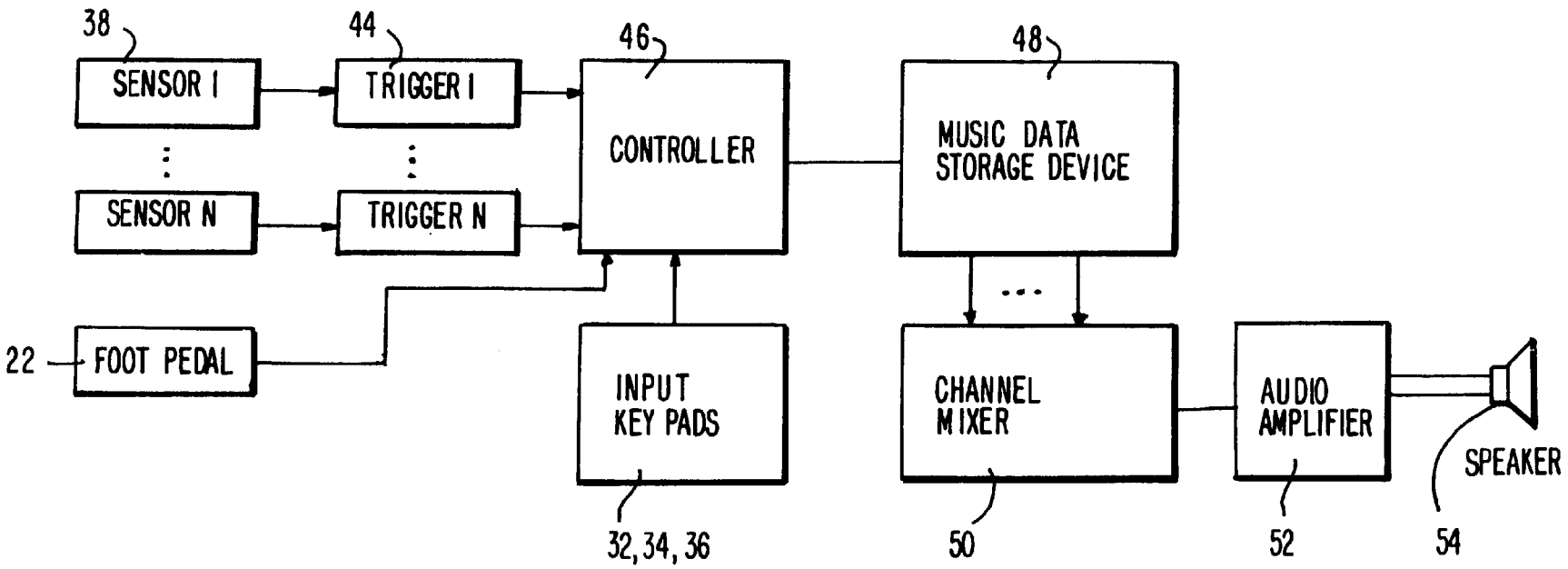
FIG. 4 is a block diagram of the electronic control system of the interactive drum set of FIG. 1.

FIG. 4 diagrammatically illustrates the electronic control system of the interactive drum set 10. As shown, the output of each sensor 38 is connected to the input of a respective triggering device 44. Advantageously, each triggering device 44 is configured to output a signal only when, for example, the amplitude of the analog signal from the force/strain sensor 38 exceeds a predetermined threshold value so that sounds will be generated only if the forces imparted to or experienced by the drum plate are sufficiently great. This feature is particularly advantageous if the drum plate is made of a highly flexible material having little or no damping, because without the triggering device 44, the drum set 10 could repeatedly, and undesirably, output drum sounds so long as the drum plate continues to vibrate. The triggering device 44 also serves as a further safeguard against "crosstalk" or coupling of vibration between the drum plates 14, 16, 18, 20, as drum plate vibrations resulting from crosstalk will be insufficient to activate the triggering device 44.

The control system includes an electronic controller 46 for receiving the output signals from the triggering devices 44 and the user command signals (representing, for example, the user's selection of a background music style and/or drum beat sequence) generated by the switches of the key pad arrangements 32, 34 and the foot pedal 22 and supplies control signals to a music data storage device 48. The foot pedal 22 is operatively connected to the controller 46 and is preferably constructed as an ON/OFF switch so that when the foot pedal 22 is moved to the ON position the controller 46 retrieves and outputs data representing sounds of, for example, a bass drum from said storage device 48.

The music data storage device 48, which may form an integral portion of the controller 46, stores data (e.g., in digital format) representing sounds of the various prerecorded background music styles, drum beat sequences associated with each background music style, and sounds of various percussion instruments. Preferably, these stored sound data represent prerecorded, rather than synthesized, sounds so as to provide the user a more realistic experience. The music data storage device 48 responds to the control signals of the controller 46 and selectively outputs data representing the aforementioned sounds. If the output signals of the storage device 48 are digital signals, a digital-to-analog converter is preferably provided to convert the signals into analog signals. The data from the storage device 48 are outputted through, for example, a plurality of channels such that each channel carries a stream of data representing sounds of a background music style, a drum beat sequence, or a percussion instrument.

A channel mixer 50 then combines the signals from each of the channels of the storage device 48 into a combined-sound signal which is then supplied to an audio amplifier 52. Finally, one or more speakers 54 coupled to the output of the audio amplifier 52 convert the analog signal into acoustic waves representing the desired background music style, the associated drum beat sequence, and/or the sounds of the percussion instruments selectively activated by the impacted drum plates 14, 16, 18 and 20.

Figure 5A:
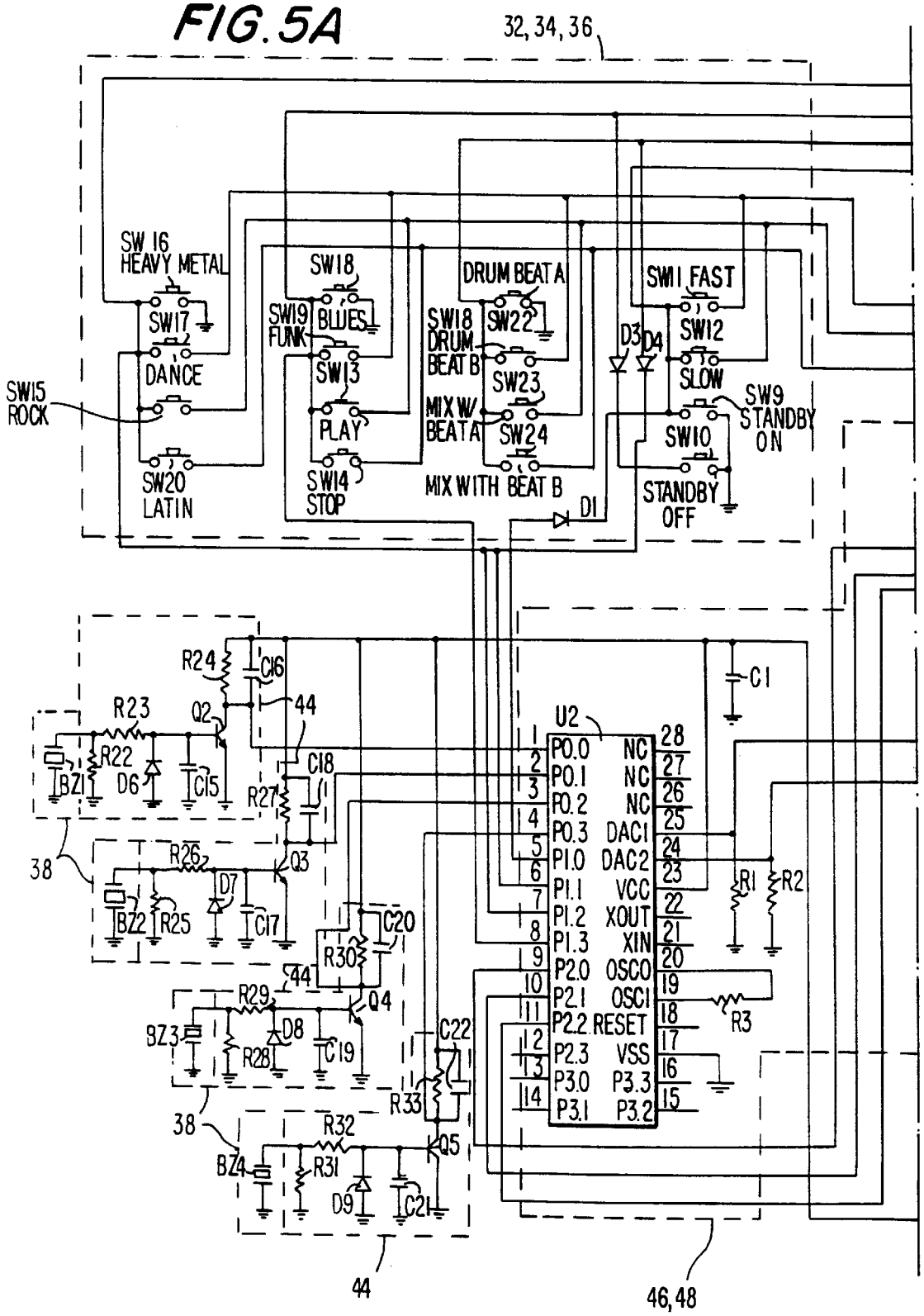
FIGS. 5A and 5B are a circuit diagram of the electronic control system of the interactive drum set of FIG. 1.
Figure 5B:
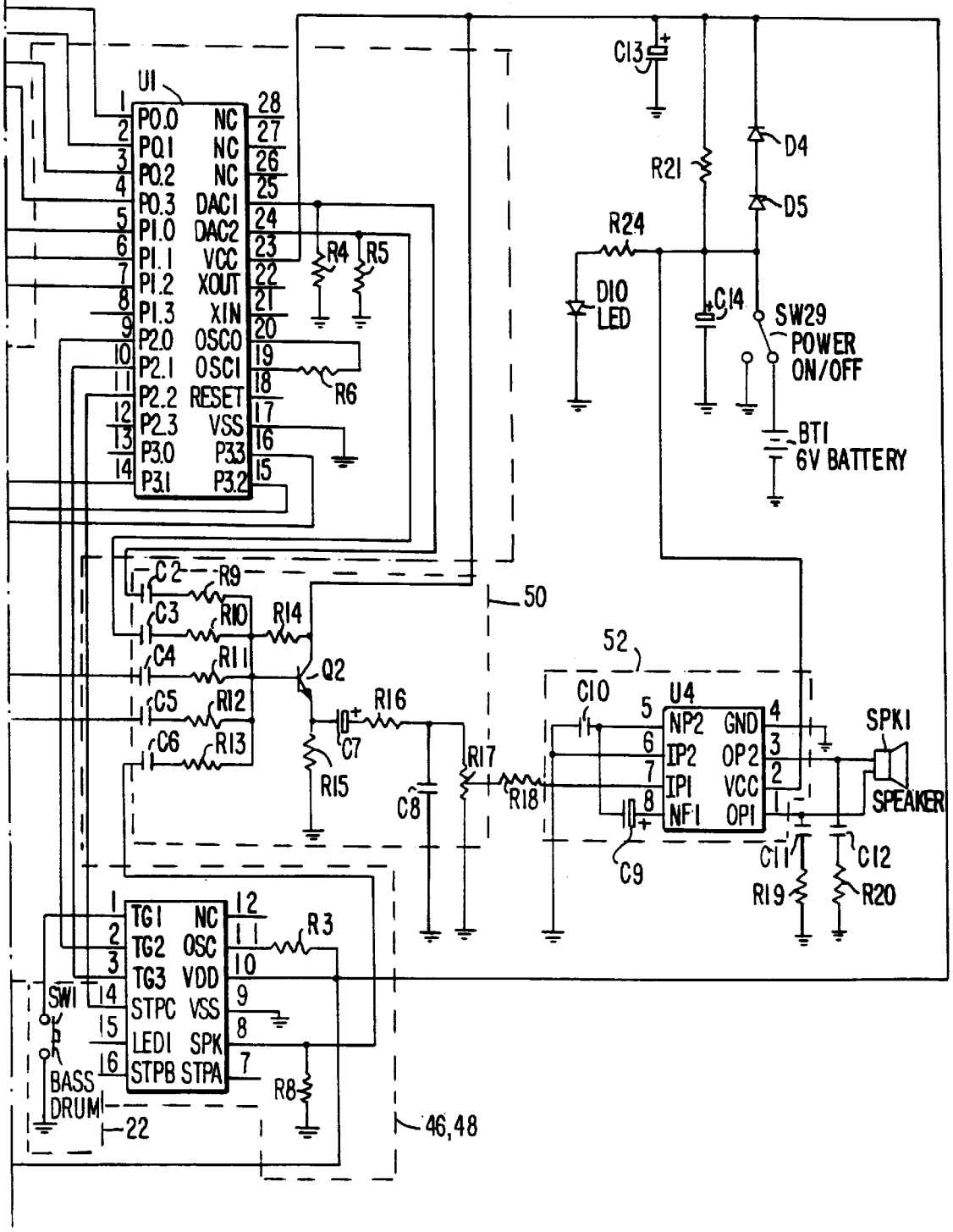

FIGS. 5A and 5B are a circuit diagram of the presently preferred embodiment of the interactive drum set 10, with the functional blocks of FIG. 4 denoted by dashed lines. FIGS. 6A and 6B are a parts list corresponding to the circuit diagram of FIGS. 5A and 5B.

As is apparent from the disclosure above, the drum set 10 provides four operating modes in which it plays: (1) a selected background music style and a selected prerecorded drum beat sequence; (2) a selected prerecorded drum beat sequence without any background music; (3) a selected background music style without any prerecorded drum beat sequence; and (4) none of the prerecorded background music styles or drum beat sequences.

Advantageously, each of the modes provides a different level of challenge to the user so as to progressively guide the user to learn a selected drum beat sequence for a background music style. For example, after selecting a background music style and an associated drum beat sequence, the user may activate mode (1) of the drum set 10 so that the drum set 10 plays repetitively the selected background music and drum beat sequence so as to familiarize the user with the music rhythm and beats. The user may also vary the playback speed using a tempo control switch 36 to accommodate his needs or preferences. Once the user feels comfortable with the selected drum beat sequence, he may attempt to follow the drum beat sequence being outputted by striking the drum plates 14, 16, 18, 20 with the drum sticks 26 in a sequence similar to the selected drum sequence. Once the user is comfortable with the drum beat sequence, the user may activate mode (2) of the drum set 10 so that the drum set 10 plays only the selected drum beat sequence, i.e. without the associated background music. This mode is particularly helpful to a user who is somewhat familiar with the drum beat sequence but desires to master or perfect his playing of the drum beats.

Afterward, the user may activate mode (3) of the drum set 10 wherein the drum set 10 plays only the selected background music. This mode advantageously permits the user to perform the drum beat sequence he just learned in accompaniment to the sounds of the selected background music style. When successfully performed, the user will gain a gratifying sense of accomplishment.

At any time during a practice session, the user may engage in free play of the drum plates 14, 16, 18, 20 and thus the selected percussion instruments by activating mode (4) of the drum set 10, wherein the drum set does not play any of the prerecorded drum beat sequence or background music. This mode is particularly valuable for those users who desire to create new drum beat sequences, or alternatively, wish to practice the drum beat sequence without listening to any of the background music or prerecorded drum beat sequence.

Having successfully learned the selected drum beat sequence, the user may now proceed to learn another prerecorded drum beat sequence associated with the previously selected music style. Optionally, the user may pick another music style and learn the prerecorded drum beat sequences associated therewith, all as more fully described above.

Thus, while there have shown and described and pointed out fundamental novel features of the invention as applied to preferred embodiments thereof, it will be understood that various omissions and substitutions and changes in the form and details of the devices illustrated, and in their operation, may be made by those of ordinary skill in the art without departing from the spirit of the invention. For example, it is expressly intended that all combinations of those elements and/or method steps which perform substantially the same function in substantially the same way to achieve substantially the same results are within the scope of the invention. It is the intention, therefore, to be limited only as indicated by the scope of the claims appended hereto.

I claim:

1. A method of providing interactive drum lessons to a user, comprising the steps of:

(a) associating each of a plurality of drum plates with sounds of one of a plurality of percussion instruments such that when one of the plurality of drum plates is struck by the user, sounds of one of the plurality of percussion instruments associated with one of the struck drum plates is outputted;

(b) associating sounds of a background music'style with a drum beat sequence;

(c) outputting sounds of said background music style and said drum beat sequence when indicated by the user so that the user can become familiarized with said drum beat sequence by listening to the sounds of both said background music style and said drum beat sequence and by striking the plurality of drum plates in a sequence similar to said drum beat sequence;

(d) outputting sounds of only said drum beat sequence when indicated by the user so that the user may learn said drum beat sequence by listening only to the sounds of said drum beat sequence and by striking the plurality of drum plates in a sequence substantially the same as said drum beat sequence;

(e) outputting sounds of only the background music style when indicated by the user so that the user may perform the drum beat sequence while the sounds of said background music style are being outputted; and (f) outputting none of the sounds of said background music style and said drum beat sequence when indicated by the user so that the user may engage in free play of the drum plates.

2. The method of claim 1, wherein step (b) comprises associating prerecorded sounds of said background music style with prerecorded sounds of said at least one drum beat sequence.

3. The method of claim 1, wherein step (b) comprises associating sounds of one of Latin, Rock, Heavy Metal, Dance, Funk, and Blues as said background music style with sounds of at least one drum beat sequence.

4. The method of claim 1, further comprising the step of associating said background music style with a second drum beat sequence so that the user may learn said second drum beat sequence.

5. An interactive drum set comprising:

a storage device for storing data representing sounds of at least one background music style, sounds of at least one drum beat sequence, and sounds of a plurality of percussion instruments;

a plurality of drum plates, each of said plurality of drum plates being associated with said data representing sounds of one of said plurality of percussion instruments;

a sensor disposed at each of the plurality of drum plates for detecting a user-directed force imparted to a selected drum plate and for generating a signal indicative of the detected user-directed force;

a triggering device operatively connected-to each said sensor for outputting a trigger signal when said signal from said sensor exceeds a threshold value so that sounds will be generated if the user-directed force detected by said sensor is sufficiently great, thereby minimizing crosstalk between at least two of the plurality of drum plates;

a user-interface device responsive to user commands for supplying signals indicative of a user's selection of at least one of said at least one background music style and said at least one drum beat sequence; and a controller responsive to said trigger signal of the triggering device for outputting the data representing sounds of the percussion instrument associated with the drum plate receiving the user-directed force, said controller also responsive to said signal from said user-interface device for engaging in one of the four following operating modes:

(1) outputting data representing the selected background music style and the selected drum beat sequence;

(2) outputting data representing the selected drum beat sequence only;

(3) outputting data representing the selected background music style only; and (4) outputting none of the data representing at least one of the selected background music style and drum beat sequence.

6. The interactive drum set of claim 5, wherein said storage device outputs data through a plurality of channels, each of said plurality of channels carrying data representing sounds of one of said background music style, said drum beat sequence, and each of said plurality of percussion instruments, and further comprising a channel mixer operatively connected to said storage device for combining the outputted data from each said channel into a combined-sound signal.

7. The interactive drum set of claim 6, further comprising an audio amplifier for amplifying the combined-sound signal from the channel mixer.

8. The interactive drum set of claim 7, further comprising a speaker for converting the combined-sound signal into acoustic waves.

9. The interactive drum set of claim 5, wherein each said sensor is disposed at the bottom surface of each of said plurality of drum plates.

10. The interactive drum set of claim 9, wherein at least one of said sensors includes a piezoelectric transducer.

11. The interactive drum set of claim 5, wherein said user interface device includes a plurality of manual ON/OFF switches activatable by a user for generating the user commands.

12. The interactive drum set of claim 5, further comprising a plurality of support arms, each of said plurality of support arms has a cantilevered end, and wherein each of said plurality of drum plates is resiliently mounted on said cantilevered end of said each of said plurality of support arms so as to isolate vibratory movement of one drum plate from another drum plate.

13. The interactive drum set of claim 12, further comprising a spring interposed between the cantilevered end of each said support arm and each said drum plate.

14. The interactive drum set of claim 5, wherein one of said plurality of percussion instruments includes a bass drum, and further comprising a foot pedal operatively connected to said controller and having an ON and an OFF position so that when the foot pedal is moved to the ON position the controller retrieves and outputs data representing sounds of a bass drum from said storage device.

* * * * *